US012298009B1

(12) United States Patent
Yu et al.

(10) Patent No.: US 12,298,009 B1
(45) Date of Patent: May 13, 2025

(54) TURBINE ENGINE HAVING A REVERSE FLOW ANNULAR VORTEX COMBUSTOR

(71) Applicant: General Electric Company, Schenectady, NY (US)

(72) Inventors: Rachel Yu, Medford, MA (US); Nicholas R. Overman, Sharonville, OH (US); William David Magnuszewski, Cincinnati, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/677,200

(22) Filed: May 29, 2024

(51) Int. Cl.
*F23R 3/54* (2006.01)
*F23R 3/46* (2006.01)
*F23R 3/58* (2006.01)

(52) U.S. Cl.
CPC ..... *F23R 3/54* (2013.01); *F23R 3/46* (2013.01); *F23R 3/58* (2013.01)

(58) Field of Classification Search
CPC ..... F23R 3/54; F23R 3/46; F23R 3/58; F23R 3/34; F23R 3/06; F23R 3/12
See application file for complete search history.

(56) References Cited

U.S. PATENT DOCUMENTS 3,333,414 A * 8/1967 Saintsbury ..... F23R 3/12 137/896
3,869,864 A * 3/1975 Bunn ..... F23R 3/12 60/749
4,702,073 A 10/1987 Melconian
5,265,425 A 11/1993 Howell
5,469,700 A * 11/1995 Corbett ..... F02C 9/28 60/776
5,746,048 A * 5/1998 Shah ..... F23R 3/50 60/776
6,497,103 B2 12/2002 Johnson et al.
6,826,912 B2 * 12/2004 Levy ..... F23C 9/006 60/750
6,951,108 B2 10/2005 Burrus et al.
8,272,219 B1 9/2012 Johnson et al.
10,823,422 B2 11/2020 Johnson et al.
11,828,469 B2 11/2023 Overman et al.
(Continued)

FOREIGN PATENT DOCUMENTS

GB 653289 A 5/1951
WO 2018190926 A1 10/2018
WO 2022154693 A1 7/2022

*Primary Examiner* — Steven M Sutherland
(74) *Attorney, Agent, or Firm* — Venable LLP; Peter T. Hrubiec; Michele V. Frank

(57) ABSTRACT

A gas turbine engine including a compressor section for compressing air flowing therethrough to provide a compressed air flow and a reverse flow annular vortex combustor including a combustion chamber having a primary combustion zone, the combustion chamber configured to combust a mixture of a fuel flow and the compressed air flow in the primary combustion zone to generate a primary zone vortex. The reverse flow annular vortex combustor has a combustor liner and one or more driver openings extending through the combustor liner, the one or more driver openings providing a driver air flow formed of the compressed air flow. The driver air flow enters the combustion chamber as a wall of air for shaping and driving the primary zone vortex in the combustion chamber.

20 Claims, 5 Drawing Sheets

(56) References Cited

U.S. PATENT DOCUMENTS

| | | | |
|---|---|---|---|
| 11,920,791 | B1 | 3/2024 | Overman |
| 2012/0023964 | A1 | 2/2012 | Mehring |
| 2022/0090788 | A1 | 3/2022 | Duncan et al. |

* cited by examiner

TURBINE ENGINE HAVING A REVERSE FLOW ANNULAR VORTEX COMBUSTOR

TECHNICAL FIELD

The present disclosure relates generally to a reverse flow annular vortex combustor, for example, in a turbine engine.

BACKGROUND

Turbine engines generally include a propulsor (e.g., a fan or a propeller) and a turbo-engine arranged in flow communication with one another. The turbo-engine includes a compressor section, a combustion section, and a turbine section. The combustion section includes a combustor for generating combustion products.

BRIEF DESCRIPTION OF THE DRAWINGS

Features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
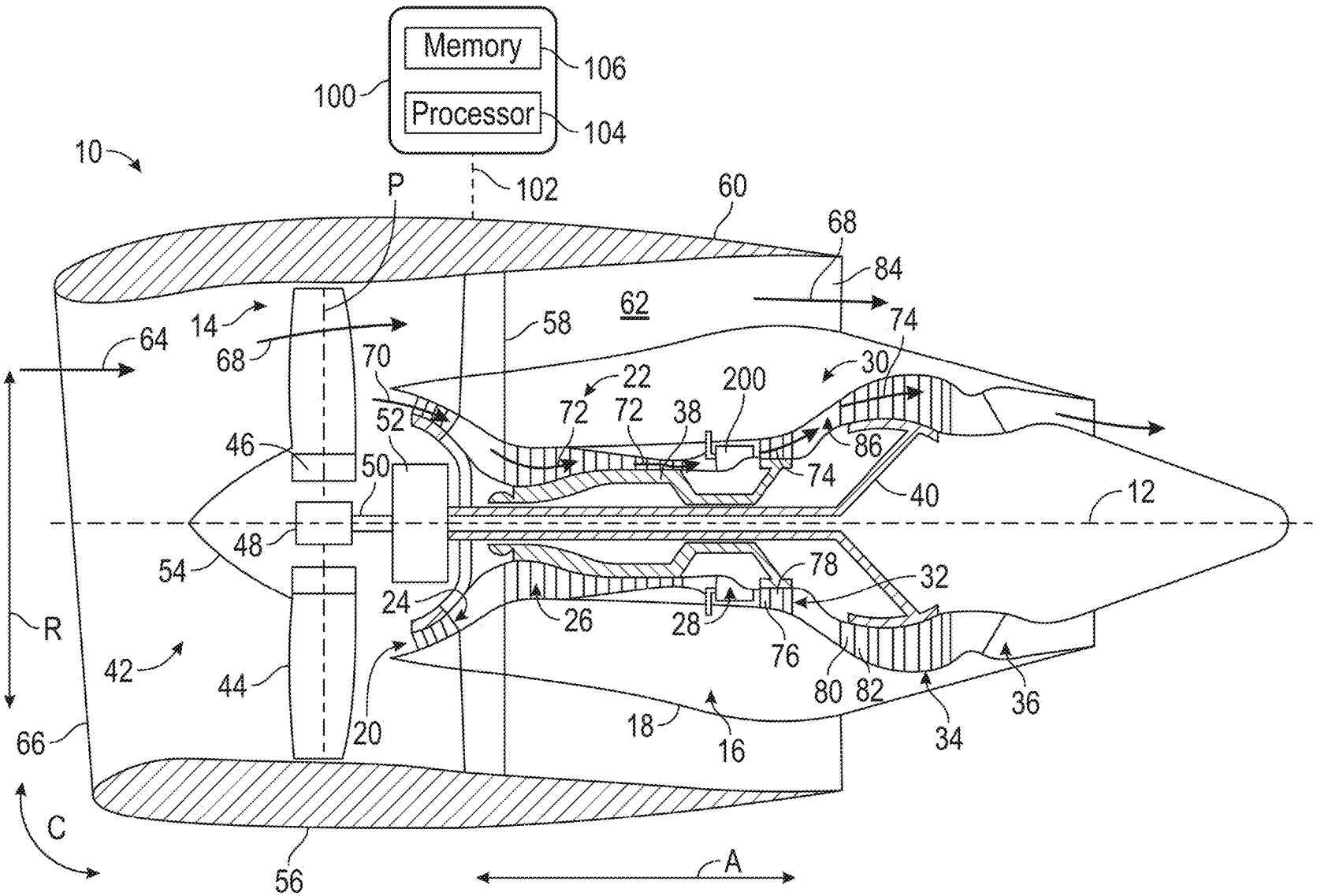
FIG. 1 illustrates a schematic cross-sectional view of a gas turbine engine, taken along a longitudinal centerline axis of the engine, according to the present disclosure.

Features, advantages, and embodiments of the present disclosure are set forth or apparent from a consideration of the following detailed description, drawings, and claims. Moreover, the following detailed description is exemplary and intended to provide further explanation without limiting the scope of the disclosure as claimed.

Various embodiments of the present disclosure are discussed in detail below. While specific embodiments are discussed, this is done for illustration purposes only. A person skilled in the relevant art will recognize that other components and configurations may be used without departing from the present disclosure.

As used herein, the terms "first," "second," and the like, may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "forward" and "aft" refer to relative positions within a turbine engine or a vehicle, and refer to the normal operational attitude of the turbine engine or the vehicle. For example, with regard to a turbine engine, forward refers to a position closer to an engine inlet and aft refers to a position closer to an engine nozzle or an exhaust.

As used herein, the terms "low," "mid" (or "mid-level"), and "high," or their respective comparative degrees (e.g., "lower" and "higher", where applicable), when used with compressor, turbine, shaft, fan, or turbine engine components, each refers to relative pressures, relative speeds, relative temperatures, and/or relative power outputs within an engine unless otherwise specified. For example, a "low power" setting defines the engine configured to operate at a power output lower than a "high power" setting of the engine, and a "mid-level power" setting defines the engine configured to operate at a power output higher than a "low power" setting and lower than a "high power" setting. The terms "low," "mid" (or "mid-level"), or "high" in such aforementioned terms may additionally, or alternatively, be understood as relative to minimum allowable speeds, pressures, or temperatures, or minimum or maximum allowable speeds, pressures, or temperatures relative to normal, desired, steady state, etc., operation of the engine.

The terms "coupled," "fixed," "attached," "connected," and the like, refer to both direct coupling, fixing, attaching, or connecting, as well as indirect coupling, fixing, attaching, or connecting through one or more intermediate components or features, unless otherwise specified herein. The terms include integral and unitary configurations (e.g., blisk rotor blade systems).

The singular forms "a," "an," and "the" include plural references unless the context clearly dictates otherwise.

As used herein, the terms "axial" and "axially" refer to directions and orientations that extend substantially parallel to a centerline of the turbine engine. Moreover, the terms "radial" and "radially" refer to directions and orientations that extend substantially perpendicular to the centerline of the turbine engine. In addition, as used herein, the terms "circumferential" and "circumferentially" refer to directions and orientations that extend arcuately about the centerline of the turbine engine.

Here and throughout the specification and claims, range limitations are combined, and interchanged. Such ranges are identified and include all the sub-ranges contained therein unless context or language indicates otherwise. For example, all ranges disclosed herein are inclusive of the endpoints, and the endpoints are independently combinable with each other.

The present disclosure provides combustors having driver openings to shape and to maintain vortices within the combustor. The present disclosure provides an annular vortex combustor that is a reverse flow combustor. In some examples, the inner liner is contoured to help shape the primary zone vortex, to increase cold side volume to feed the inner liner, and to create a larger inner turning radius. In some examples, two counter rotating vortices are created by primary and secondary driver openings prior to the flow reversing and entering the turbine. In some examples, three vortices are created by axially staggered driver openings to increase mixing and residence time. In some examples, the driver openings are oriented radially, with or without an axial angle, to shape vortices, but with no bulk tangential swirl. In some examples, the driver openings are oriented radially and tangentially to induce a bulk tangential swirl, with or without an axial angle to shape the vortices.

Referring now to the drawings, FIG. 1 is a schematic cross-sectional view of a turbine engine 10, taken along a longitudinal centerline axis 12 of the turbine engine 10, according to an embodiment of the present disclosure. As shown in FIG. 1, the turbine engine 10 defines an axial direction A (extending parallel to the longitudinal centerline axis 12 provided for reference), a radial direction R that is normal to the axial direction A, and a circumferential direction C extending about the longitudinal centerline axis 12. In general, the turbine engine 10 includes a fan section 14 and a turbo-engine 16 disposed downstream from the fan section 14.

The turbo-engine 16 includes, in serial flow relationship, a compressor section 22, a combustion section 28, and a turbine section 30. The turbo-engine 16 is substantially enclosed with an outer casing 18 that is substantially tubular and defines an annular inlet 20. As schematically shown in FIG. 1, the compressor section 22 includes a booster or a low-pressure (LP) compressor 24 followed downstream by a high-pressure (HP) compressor 26. The combustion section 28 includes a combustor 200 and is downstream of the compressor section 22. The turbine section 30 is downstream of the combustion section 28 and includes a high-pressure (HP) turbine 32 followed downstream by a low-pressure (LP) turbine 34. The turbo-engine 16 further includes a jet exhaust nozzle section 36 that is downstream of the turbine section 30, a high-pressure (HP) shaft 38 or a spool, and a low-pressure (LP) shaft 40. The HP shaft 38 drivingly connects the HP turbine 32 to the HP compressor 26. The HP turbine 32 and the HP compressor 26 rotate in unison through the HP shaft 38. The LP shaft 40 drivingly connects the LP turbine 34 to the LP compressor 24. The LP turbine 34 and the LP compressor 24 rotate in unison through the LP shaft 40. The compressor section 22, the combustion section 28, the turbine section 30, and the jet exhaust nozzle section 36 together define a core air flow path.

For the embodiment depicted in FIG. 1, the fan section 14 includes a fan 42 (e.g., a variable pitch fan) having a plurality of fan blades 44 coupled to a disk 46 in a spaced apart manner. As depicted in FIG. 1, the fan blades 44 extend outwardly from the disk 46 generally along the radial direction R. In the case of a variable pitch fan, the plurality of fan blades 44 are rotatable relative to the disk 46 about a pitch axis P by virtue of the fan blades 44 being operatively coupled to an actuation member 48 configured to collectively vary the pitch of the fan blades 44 in unison. The fan blades 44, the disk 46, and the actuation member 48 are together rotatable about the longitudinal centerline axis 12 via a fan shaft 50 that is powered by the LP shaft 40 across a power gearbox, also referred to as a gearbox assembly 52. In this way, the fan 42 is drivingly coupled to, and powered by, the turbo-engine 16, and the turbine engine 10 is an indirect drive engine. The gearbox assembly 52 is shown schematically in FIG. 1. The gearbox assembly 52 is a reduction gearbox assembly for adjusting the rotational speed of the fan shaft 50 and, thus, the fan 42 relative to the LP shaft 40 when power is transferred from the LP shaft 40 to the fan shaft 50.

Referring still to the exemplary embodiment of FIG. 1, the disk 46 is covered by a rotatable fan hub 54 aerodynamically contoured to promote an airflow through the plurality of fan blades 44. In addition, the fan section 14 includes an annular fan casing or a nacelle 56 that circumferentially surrounds the fan 42 and at least a portion of the turbo-engine 16 by a plurality of outlet guide vanes 58 that are circumferentially spaced about the nacelle 56 and the turbo-engine 16. Moreover, a downstream section 60 of the nacelle 56 extends over an outer portion of the turbo-engine 16, and, with the outer casing 18, defines a bypass airflow passage 62 therebetween.

During operation of the turbine engine 10, a volume of air 64 enters the turbine engine 10 through an inlet 66 of the nacelle 56 or the fan section 14. As the volume of air 64 passes across the fan blades 44, a first portion of air 68, also referred to as bypass air 68, is routed into the bypass airflow passage 62, and a second portion of air 70, also referred to as core air 70, is routed into the upstream section of the core air flow path through the annular inlet 20 of the LP compressor 24. The ratio between the bypass air 68 and the core air 70 is commonly known as a bypass ratio. The pressure of the core air 70 is then increased, generating compressed air 72. The compressed air 72 is routed through the HP compressor 26 and into the combustion section 28, wherein the compressed air 72 is mixed with fuel and ignited to generate combustion gases 74.

The combustion gases 74 are routed into the HP turbine 32 and expanded through the HP turbine 32 where a portion of thermal energy and kinetic energy from the combustion gases 74 is extracted via one or more stages of HP turbine stator vanes 76 and HP turbine rotor blades 78 that are coupled to the HP shaft 38. This causes the HP shaft 38 to rotate, thereby supporting operation of the HP compressor 26 (self-sustaining cycle). In this way, the combustion gases 74 do work on the HP turbine 32. The combustion gases 74 are then routed into the LP turbine 34 and expanded through the LP turbine 34. Here, a second portion of thermal energy and the kinetic energy is extracted from the combustion gases 74 via one or more stages of LP turbine stator vanes 80 and LP turbine rotor blades 82 that are coupled to the LP shaft 40. This causes the LP shaft 40 to rotate, thereby supporting operation of the LP compressor 24 (self-sustaining cycle) and rotation of the fan 42 via the gearbox assembly 52. In this way, the combustion gases 74 do work on the LP turbine 34.

The combustion gases 74 are subsequently routed through the jet exhaust nozzle section 36 of the turbo-engine 16 to provide propulsive thrust. Simultaneously, the bypass air 68 is routed through the bypass airflow passage 62 before being exhausted from a fan nozzle exhaust section 84 of the turbine engine 10, also providing propulsive thrust. The HP turbine 32, the LP turbine 34, and the jet exhaust nozzle section 36 at least partially define a hot gas path 86 for routing the combustion gases 74 through the turbo-engine 16.

The turbine engine 10 may be communicatively and operatively coupled to an engine controller 100 along a communication line 102. The engine controller 100 is configured to operate various aspects of the turbine engine 10. The engine controller 100 may be a Full Authority Digital Engine Control (FADEC). In this embodiment, the engine controller 100 is a computing device having one or more processors 104 and one or more memories 106. The processor 104 may be any suitable processing device, including, but not limited to, a microprocessor, a microcontroller, an integrated circuit, a logic device, a programmable logic controller (PLC), an application-specific integrated circuit (ASIC), and/or a Field Programmable Gate Array (FPGA). The memory 106 may include one or more computer-readable media, including, but not limited to, non-transitory computer-readable media, a computer-readable non-volatile medium (e.g., a flash memory), a RAM, a ROM, hard drives, flash drives, and/or other memory devices.

The memory 106 may store information accessible by the processor 104, including computer-readable instructions that may be executed by the processor 104. The instructions may be any set of instructions or a sequence of instructions that, when executed by the processor 104, causes the processor 104 and the engine controller 100 to perform operations. In some embodiments, the instructions may be executed by the processor 104 to cause the processor 104 to complete any of the operations and functions for which the engine controller 100 is configured, as will be described further below. The instructions may be software written in any suitable programming language, or may be implemented in hardware. Additionally, and/or alternatively, the instructions may be executed in logically and/or virtually separate threads on the processor 104. The memory 106 may further store data that may be accessed by the processor 104.

The technology discussed herein makes reference to computer-based systems and actions taken by, and information sent to and from, computer-based systems. One of ordinary skill in the art will recognize that the inherent flexibility of computer-based systems allows for a great variety of possible configurations, combinations, and divisions of tasks and functionality between components and among components. For instance, processes discussed herein may be implemented using a single computing device or multiple computing devices working in combination. Databases, memory, instructions, and applications may be implemented on a single system or distributed across multiple systems. Distributed components may operate sequentially or in parallel.

The engine controller 100 may be communicatively coupled to one or more sensors employed in the methods of the present disclosure, such as, for example, vibration sensors (such as accelerometers), temperature sensors, speed sensors, and other sensors within the turbine engine 10. For example, the engine controller 100 may receive, and optionally store or record, data or information from the one or more sensors. The engine controller 100 may also control motoring of the turbine engine (e.g., rotation of the rotor described in more detail to follow).

The turbine engine 10 depicted in FIG. 1 is by way of example only. In other exemplary embodiments, the turbine engine 10 may have any other suitable configuration. For example, in other exemplary embodiments, the fan 42 may be configured in any other suitable manner (e.g., as a variable pitch fan or a fixed pitch fan) and further may be supported using any other suitable fan frame configuration. Moreover, in other exemplary embodiments, any other suitable number or configuration of compressors, turbines, shafts, or a combination thereof may be provided. In other exemplary embodiments, the engine may also be a direct drive engine, which does not have a power gearbox (e.g., no gearbox assembly 52). The fan speed is the same as the LP shaft speed for a direct drive engine. In still other exemplary embodiments, aspects of the present disclosure may be incorporated into any other suitable turbine engine, such as, for example, turbofan engines, propfan engines, turboprop engines, unducted engines, or turboshaft engines.

Figure 2:
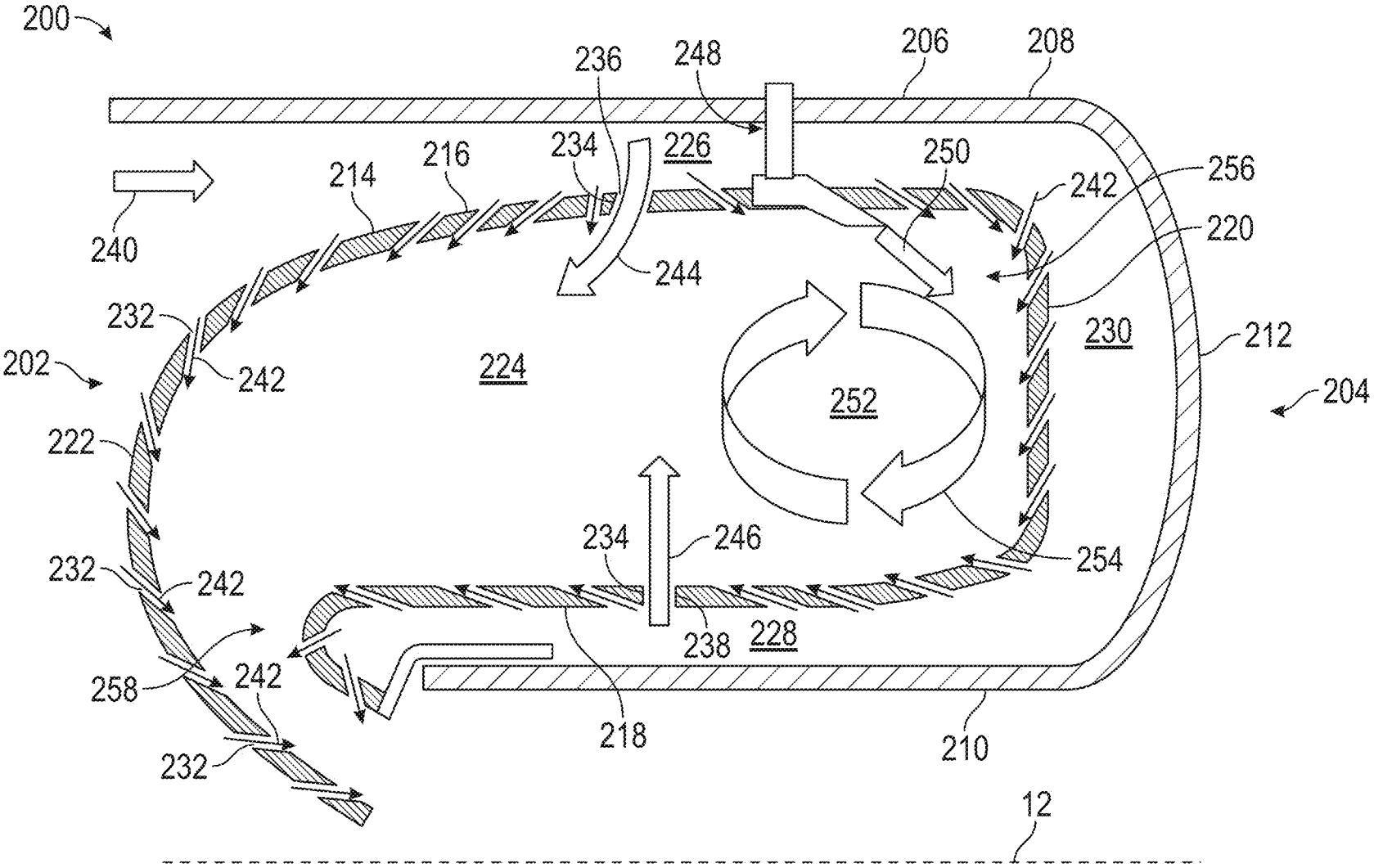
FIG. 2 illustrates a schematic cross-sectional view of a combustor for the turbine engine of FIG. 1, taken along a longitudinal centerline axis of the combustor, according to the present disclosure.

FIG. 2 illustrates a cross-sectional view of the combustor 200 taken along the longitudinal centerline axis 12. The combustor 200 is a reverse flow annular vortex combustor with a single primary zone vortex. The combustor 200 has a forward end 202 and an aft end 204. The combustor 200 includes a combustor casing 206 and a combustor liner 214. The combustor casing 206 has an outer casing 208, an inner casing 210, and an aft end 212. The combustor liner 214 has an outer liner 216, an inner liner 218, an aft end 220, and a forward end 222. A combustion chamber 224 is formed within the combustor liner 214. More specifically, the outer liner 216 and the inner liner 218 are disposed between the outer casing 208 and the inner casing 210. The outer liner 216 and the inner liner 218 are spaced radially from each other such that the combustion chamber 224 is defined therebetween. The outer casing 208 and the outer liner 216 form an outer passage 226 therebetween, and the inner casing 210 and the inner liner 218 form an inner passage 228 therebetween. An aft passage 230 connecting the outer passage 226 and the inner passage 228 is formed between the aft end 212 and the aft end 220.

The combustor liner 214 includes a plurality of liner cooling holes 232 and one or more driver openings 234. The combustor 200 includes a first driver opening 236 extending through the outer liner 216 and a second driver opening 238 extending through the inner liner 218. As noted above, the combustor 200 receives compressed air from the compressor section 22 (FIG. 1). The compressed air from the compressor section 22 flows into the combustor 200 as an air flow 240. The air flow 240 enters the combustion chamber 224 through the plurality of liner cooling holes 232 as a cooling air flow 242. The air flow 240 also enters the combustion chamber 224 through the one or more driver openings 234. The air flow 240 enters the combustion chamber 224 through the first driver opening 236 as a first driver flow 244, also referred to herein as a first outer driver flow 244, and enters the combustion chamber 224 through the second driver opening 238 as a second driver flow 246, also referred to herein as a second inner driver flow 246.

The combustor 200 includes a fuel nozzle 248 that provides a fuel flow 250 into the combustion chamber 224. The fuel flow 250 and the air flow 240 enter the combustor 200 at an upstream end 256 and are ignited to combust within a primary combustion zone 252 of the combustion chamber 224 to generate a primary zone vortex 254. Although illustrated rotating in a clockwise direction, the primary zone vortex 254 may rotate in a counterclockwise direction. The primary combustion zone 252 is defined between the aft end 220 of the combustor liner 214 and the one or more driver openings 234. That is, the primary combustion zone 252 is upstream of the one or more driver openings 234. As illustrated in FIG. 2, the combustor 200 is arranged such that the aft end 204 of the combustor 200 forms, with respect to the flow, the upstream end 256 of the combustion chamber 224 and the forward end 202 of the combustor 200 forms, with respect to the flow, a downstream end 258 of the combustion chamber 224, thus defining a reverse flow annular vortex combustor.

As illustrated in FIG. 2, the first driver opening 236 is axially staggered from the second driver opening 238. In some examples, the driver openings may be axially aligned. Whether axially staggered or axially aligned, the first driver opening 236 may be either circumferentially aligned or circumferentially staggered with the second driver opening 238. Although illustrated at different angles, the first driver opening 236 and the second driver opening 238 may be at the same angle. Although a single driver opening of each of the first driver opening 236 and the second driver opening 238 is illustrated, each comprises a plurality of driver openings extending circumferentially about the longitudinal centerline axis 12.

During operation, the air flow 240 flows through the plurality of liner cooling holes 232 to provide liner cooling and film cooling along the inner wall of the combustor liner 214. The air flow 240 also flows through the one or more driver openings 234 into the combustion chamber 224. The air flowing through the one or more driver openings 234 drives the primary zone vortex 254. The air flowing through the one or more driver openings 234 creates an air wall or air curtain that maintains the primary zone vortex 254 in the primary combustion zone 252. The air wall prevents the air from escaping from the primary combustion zone 252, which assists in driving the primary zone vortex 254. That is, the sizing, the location, and the orientation (e.g., the angle at which the driver openings 234 are oriented) of the one or more driver openings 234 is such that the air flow (e.g., driver flows 244, 246) reinforces the primary zone vortex 254 and assists in keeping the primary zone vortex 254 spinning or rotating within the primary combustion zone 252. The sizing of the driver openings 234 affects the amount of air flow therethrough and is selected to provide an amount of air flow into the primary combustion zone 252 that will sustain the amount of swirl in the primary combustion zone 252.

As illustrated in FIG. 2, the second driver opening 238 provides the second driver flow 246 into the combustion chamber 224. The second driver opening 238 is oriented perpendicular (e.g., in the radial direction) to the longitudinal centerline axis 12, though other angles are contemplated. The second driver flow 246 provides the air wall or air curtain previously mentioned to maintain the primary zone vortex 254 in the primary combustion zone 252. The first driver opening 236 is oriented at an angle such that the first driver flow 244 enters the combustion chamber 224 in a downstream direction. The first driver flow 244 also provides an air curtain for the primary zone vortex 254, but, also assists in pulling the flow downstream within the combustion chamber 224.

Figure 3:
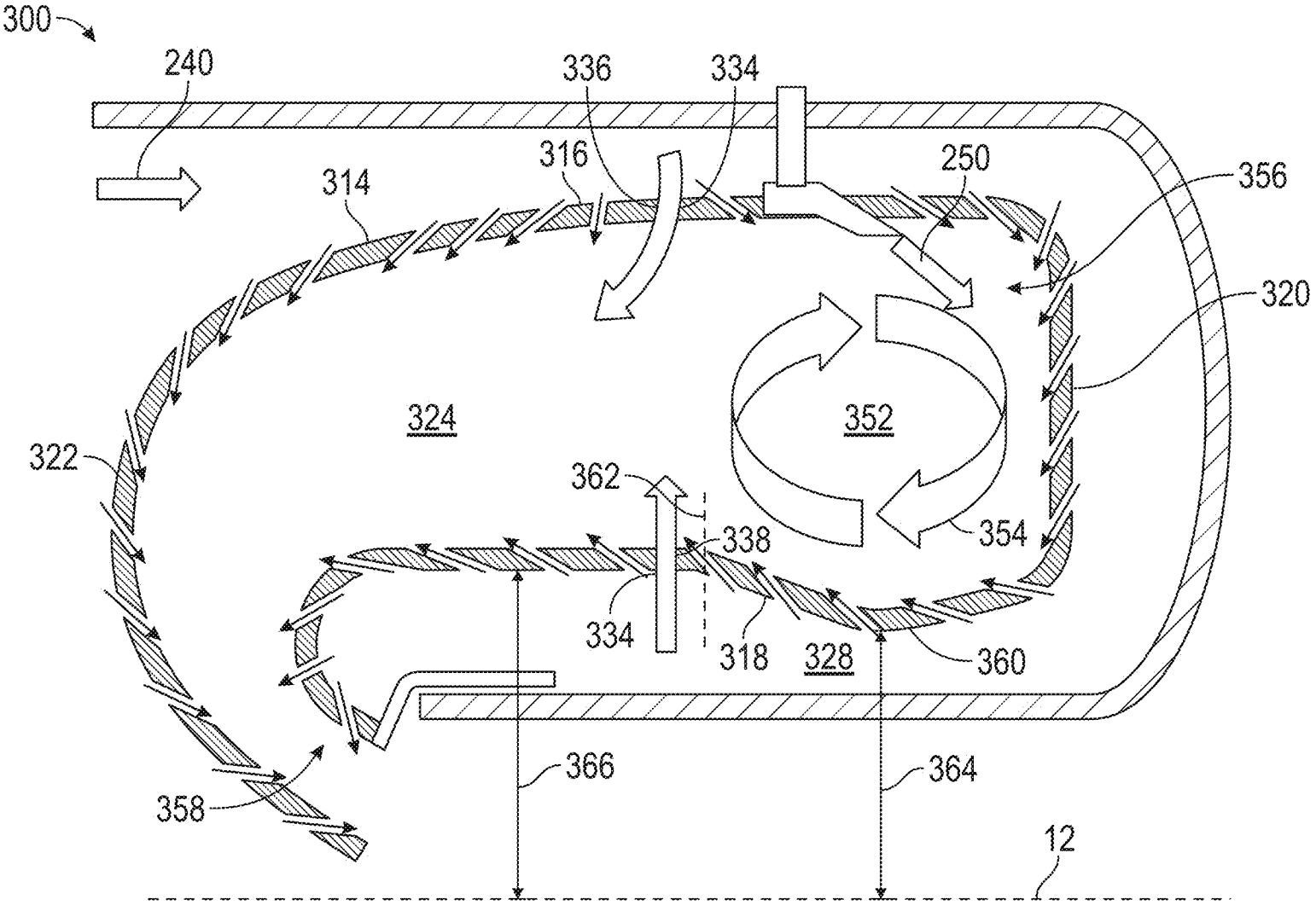
FIG. 3 illustrates a schematic cross-sectional view of a combustor for the turbine engine of FIG. 1, taken along a longitudinal centerline axis of the combustor, according to the present disclosure.

FIG. 3 illustrates a cross-sectional view of a combustor 300 taken along the longitudinal centerline axis 12. The combustor 300 may be the same as or similar to the combustor 200. Accordingly, like numbers represent like components. The difference between the combustor 300 and the combustor 200 is the contour of the combustor liner, as described in more detail to follow. The remaining structure and function is the same as described with respect to the combustor 200 of FIG. 2 and will not be described herein. Additionally, any of the alternatives to the combustor 200 apply equally to the combustor 300 of FIG. 3.

The combustor 300 is a reverse flow annular vortex combustor with a single primary zone vortex having an inner liner contour that helps shape the primary zone vortex. The combustor 300 has a combustor liner 314. The combustor liner 314 is a contoured combustor liner. A combustion chamber 324 is formed within the combustor liner 314. The combustor liner 314 has an outer liner 316, an inner liner 318, an aft end 320, and a forward end 322. The combustor liner 314 has an upstream end 356 and a downstream end 358. The inner liner 318 of the combustor 300 is contoured as compared to the inner liner 218 of the combustor 200 (FIG. 2) such that the inner liner 318 is a contoured inner liner. As in the combustor 200 described with respect to FIG. 2, the combustor 200 includes driver openings 334 including a first driver opening 336 extending through the outer liner 316 and a second driver opening 338 extending through the inner liner 318.

As illustrated in FIG. 3, a first portion 360 of the inner liner 318 may extend radially inward toward the longitudinal centerline axis 12 from the aft end 320 at a minimal radial distance 364. At the minimal radial distance 364, the inner liner 318 may extend radially outward away from the longitudinal centerline axis 12 toward a maximal radial distance 366 at a contour axis 362. In some examples, such as illustrated in FIG. 3, the contouring of the inner liner 318 is such that a primary combustion zone 352 within the combustor liner 314 is larger as compared to the primary combustion zone 252 of the combustor 200 (FIG. 2). In some examples, the primary combustion zone 352 is not larger as compared to the primary combustion zone 252 and may be equal to or smaller than the primary combustion zone 252. The illustrated contouring is by way of example, and other contouring of the inner liner 318 or outer liner 316 is contemplated as long as the contouring results in supporting and creating a strong, robust primary zone vortex 354, as described in the next paragraph. In some examples, an inner passage 328 defined between the combustor casing 206 (FIG. 2) and the inner liner 318 is larger at the forward end 322 of the combustor 300 as compared to the aft end 320 of the combustor 300.

The contouring of the combustor 300 provides additional shaping to assist in shaping, forming, and maintaining the primary zone vortex 354 located in the primary combustion zone 352. The contouring also provides the benefit of a larger turning radius of the inner liner 318 toward the downstream end 358 and the combustor outlet (larger as compared to the combustor 200). The larger turning radius assists with the flow profile of the combustion gases exiting the combustion chamber and flowing into the turbine (e.g., a first stage of the HP turbine 32). The larger inner turning radius at the downstream end 358 provides a smoother transition for a more predictable flow temperature profile and flow pattern factor as compared to a smaller inner turning radius. The contouring increases the cold side volume to feed the liner cooling holes 232 (FIG. 2) of the inner liner 318 and the second driver opening 338 of the inner liner 318 with reduced velocity air flow.

Figure 4:
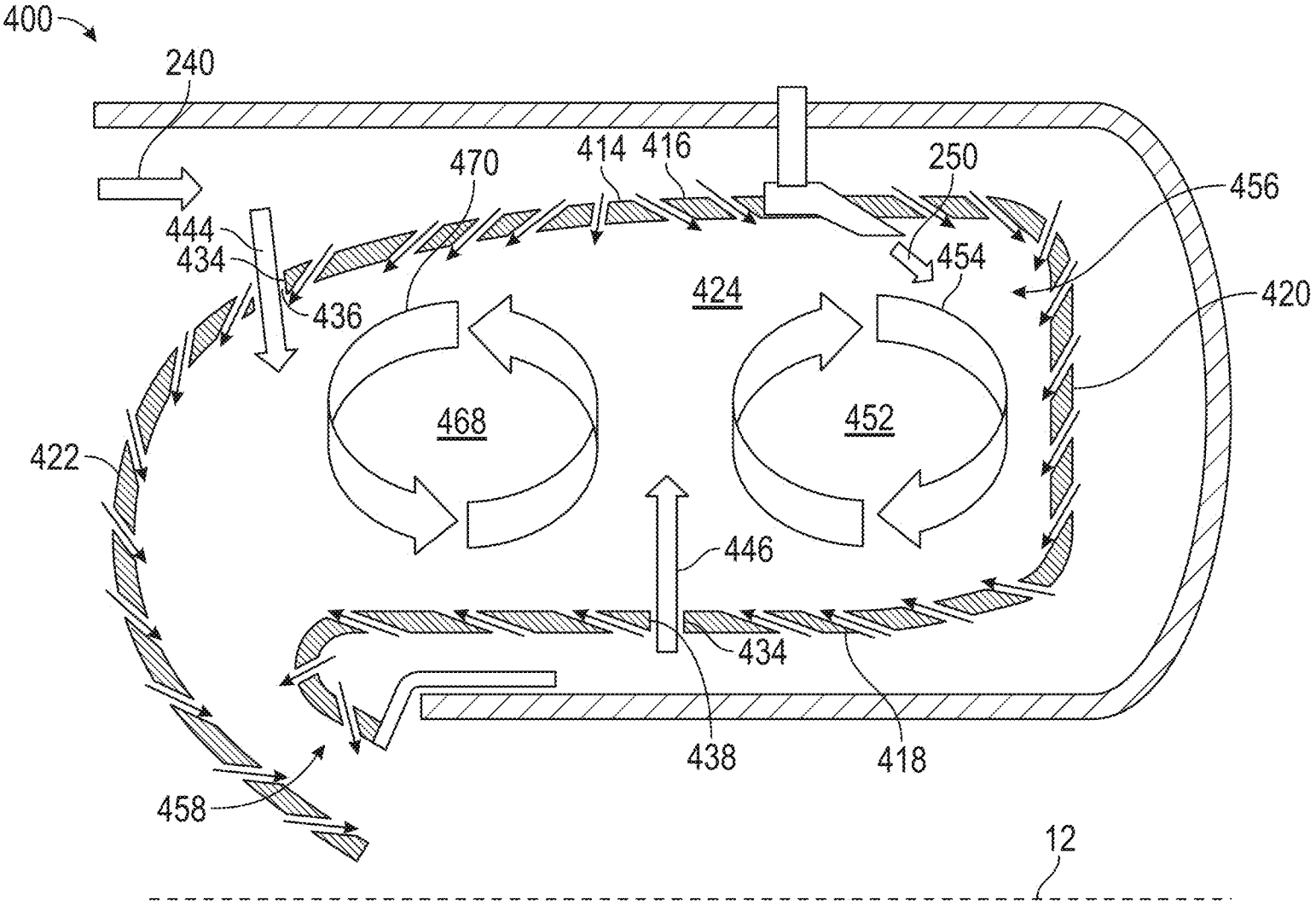
FIG. 4 illustrates a schematic cross-sectional view of a combustor for the turbine engine of FIG. 1, taken along a longitudinal centerline axis of the combustor, according to the present disclosure.

FIG. 4 illustrates a cross-sectional view of a combustor 400 taken along the longitudinal centerline axis 12. The combustor 400 may be the same as or similar to the combustor 200. Accordingly, like numbers represent like components. The difference between the combustor 400 and the combustor 200 is the location of the second driver opening, as described in more detail to follow. The remaining structure and function is the same as described with respect to the combustor 200 of FIG. 2 and will not be described herein. Additionally, any of the alternatives to the combustor 200 apply equally to the combustor 400 of FIG. 4.

The combustor 400 is a reverse flow annular vortex combustor with two vortices. The combustor 400 has a combustor liner 414. The combustor liner 414 has an outer liner 416, an inner liner 418, an aft end 420, and a forward end 422. A combustion chamber 424 is formed within the combustor liner 414 and extends from an upstream end 456 to a downstream end 458. The combustion chamber 424 has a primary combustion zone 452 and a secondary combustion zone 468. The primary combustion zone 452 is defined between the aft end 420 and a second driver opening 438 of a plurality of driver openings 434. The secondary combustion zone 468 is defined downstream of the primary combustion zone 452. The secondary combustion zone 468 is defined between a first driver opening 436 and the second driver opening 438. The first driver opening 436 is downstream of the second driver opening 438.

The fuel flow 250 and the air flow 240 enter the combustor 400 at the upstream end 456 and are ignited to combust within the primary combustion zone 452 of the combustion chamber 424 to generate a primary zone vortex 454. The location of the driver openings 434 allows for generation of a secondary zone vortex 470 within the combustion chamber 424. As illustrated in FIG. 4, the primary zone vortex 454 is located upstream of the second driver opening 438. The secondary zone vortex 470 is located upstream of the first driver opening 436 and downstream of the second driver opening 438. The secondary zone vortex 470 is downstream of and axially forward of the primary zone vortex 454. The primary zone vortex 454 and the secondary zone vortex 470 are counterrotating. In some examples, the rotation of the two vortices may be opposite to the directions illustrated in FIG. 4.

As with the combustor 200, the sizing, the location, and the orientation (e.g., the angle at which the driver openings 434 are oriented) of the one or more driver openings 434 is such that the air flow (e.g., driver flows 244, 246) reinforces the primary zone vortex 454 and the secondary zone vortex 470 and assists in keeping the primary zone vortex 454 and the secondary zone vortex 470 spinning or rotating. A driver flow 446 entering the second driver opening 438 provides a curtain or wall of air to assist the primary zone vortex 454, and a driver flow 444 entering the first driver opening 436 provides a curtain or a wall of air to assist the secondary zone vortex 470.

Figure 5:
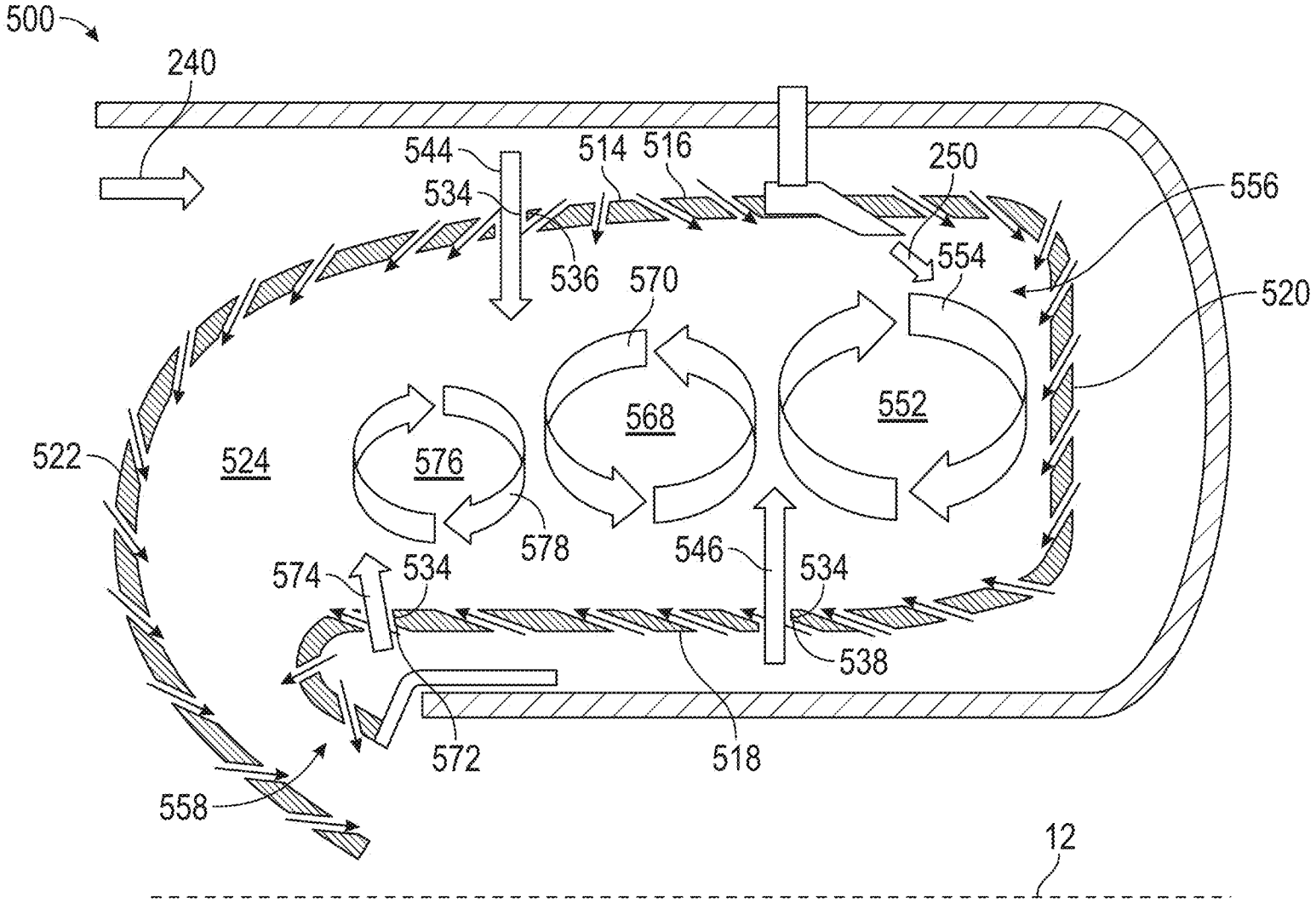
FIG. 5 illustrates a schematic cross-sectional view of a combustor for the turbine engine of FIG. 1, taken along a longitudinal centerline axis of the combustor, according to the present disclosure.

FIG. 5 illustrates a cross-sectional view of a combustor 500 taken along the longitudinal centerline axis 12. The combustor 500 may be the same as or similar to the combustor 200 (FIG. 2). Accordingly, like numbers represent like components. The difference between the combustor 500 and the combustor 200 is the inclusion of a third driver opening, as described in more detail to follow. The remaining structure and function is the same as described with respect to the combustor 200 of FIG. 2 and will not be described herein. Additionally, any of the alternatives to the combustor 200 applies equally to the combustor 500 of FIG. 5.

The combustor 500 is a reverse flow annular vortex combustor with three vortices. The combustor 500 has a combustor liner 514. The combustor liner 514 has an outer liner 516, an inner liner 518, an aft end 520, and a forward end 522. A combustion chamber 524 is formed within the combustor liner 514 and extends from an upstream end 556 to a downstream end 558. The combustion chamber 524 has a primary combustion zone 552, a secondary combustion zone 568, and a tertiary combustion zone 576. The primary combustion zone 552 is defined between the aft end 520 and a second driver opening 538 of a plurality of driver openings 534. The secondary combustion zone 568 is defined downstream of the primary combustion zone 552. The secondary combustion zone 568 is defined between a first driver opening 536 and the second driver opening 538. The first driver opening 536 is downstream of the second driver opening 538. The tertiary combustion zone 576 is defined downstream of the secondary combustion zone 568. The tertiary combustion zone 576 is defined between the first driver opening 536 and a third driver opening 572. The third driver opening 572 is downstream of the first driver opening 536.

The fuel flow 250 and the air flow enter the combustor 500 at the upstream end 556 and are ignited to combust within a primary combustion zone 552 of the combustion chamber 524 to generate a primary zone vortex 554. The location of the driver openings 534 allows for generation of a secondary zone vortex 570 within the secondary combustion zone 568 and generation of a tertiary zone vortex 578 within the tertiary combustion zone 576. As illustrated in FIG. 5, the primary zone vortex 554 is located upstream of the second driver opening 538. The secondary zone vortex 570 is located upstream of the first driver opening 536 and downstream of the second driver opening 538. The tertiary zone vortex 578 is located upstream of the third driver opening 572 and downstream of the first driver opening 536. The secondary zone vortex 570 is downstream of and axially forward of the primary zone vortex 554. The tertiary zone vortex 578 is downstream of and axially forward of the secondary zone vortex 570. The secondary zone vortex 570 is counterrotating to the primary zone vortex 554 and the tertiary zone vortex 578. In particular, the primary zone vortex 554 and the tertiary zone vortex 578 rotate in the same direction, and the secondary zone vortex 570 rotates in the opposite direction as the primary zone vortex 554 and the tertiary zone vortex 578. In some examples, the rotation of the vortices may be the opposite to the directions illustrated in FIG. 5.

As with the combustor 200, the sizing, the location, and the orientation (e.g., the angle at which the driver openings 534 are oriented) of the one or more driver openings 534 is such that the air flow (e.g., driver flows 544, 546, and 574) reinforces the primary zone vortex 554, the secondary zone vortex 570, and the tertiary zone vortex 578, and assists in keeping the primary zone vortex 554, the secondary zone vortex 570, and the tertiary zone vortex 578 spinning or rotating. A driver flow 546 entering the second driver opening 538 provides a curtain or a wall of air to assist the primary zone vortex 554, a driver flow 544 entering the first driver opening 536 provides a curtain or a wall of air to assist the secondary zone vortex 570, and a driver flow 574 entering the third driver opening 572 provides a curtain or a wall of air to assist the tertiary zone vortex 578.

With respect to the aspects shown in FIGS. 4 and 5, multiple vortices increase residence time and mixing, reducing pattern and profile factor (e.g., combustor exit non-uniformity as measured by a non-dimensional temperature at the combustor exit, where profile is the average temperature and pattern is the maximum temperature) and emissions. Also, axially staggered driver openings (e.g., the inner and outer driver flows) form the counter rotating vortices, and the driver openings may be angled tangentially to provide bulk swirl to the flow.

Accordingly, considering the aspects shown in FIGS. 2, 4, and 5, adding additional driver openings may allow for additional vortices to be supported within the combustor. Thus, although three vortices are illustrated in FIG. 5, more may be provided by adding additional driver openings. Furthermore, although the liner contouring is illustrated in FIG. 3 with a single vortex, the liner contouring may be applied to either of the combustor 400 (FIG. 4) or the combustor 500 (FIG. 5).

The driver openings of the present disclosure are axially staggered from one another. In some examples (e.g., as shown in FIGS. 4 and 5), the driver openings are axially staggered by a distance that allows for a secondary or a tertiary vortex to form. The driver openings of the present disclosure may be perpendicular to the longitudinal centerline axis 12 or may be angled (radially, circumferentially, or both) with respect to the longitudinal centerline axis 12 at an angle greater than zero degrees and less than ninety degrees. In some examples, the angle may be tangential to an inner surface of the combustor liner 214. Each driver hole of the one or more driver openings is larger than each cooling hole of the plurality of cooling holes. The sizing of the plurality of cooling holes is such that they permit cooling of the internal surface of the combustor liner, but do not form an air wall or assist with shaping of the vortex, as with the driver openings.

As illustrated, the driver openings of each of the combustors described herein are oriented in a radial direction. In some examples, the driver openings are also angled in the axial direction (e.g., angled left and right on the page with respect to the longitudinal centerline axis 12). In some examples, the driver openings are also angled in the circumferential direction (e.g., angled into and out of the page with respect to the longitudinal centerline axis 12). In some examples, the driver openings are also both axially and circumferentially angled. In some examples, the driver openings are angled such that the openings are tangential with an internal surface of the combustor liner.

Accordingly, the reverse flow annular vortex combustors of the present disclosure allow for increased residence time, while also allowing for decreased combustor length, as compared to forward to aft flowing combustors. The driver openings present in the combustors of the present disclosure assist in shaping the vortex. The increased residence time and the shaping of the vortex increase mixing of the fuel and air.

The reverse flow annular vortex combustors of the present disclose provide (1) a vortex that is fed (e.g., air fed) in the direction of the inlet air flow, (2) no turning losses when feeding the fuel block, (3) a larger inner turning radius (e.g., FIG. 4) provides smoother transition and more predictable profile and pattern factor, (4) second and third vortices (e.g., FIGS. 5 and 6) increase residence time and mixing, (5) driver openings are positioned to shape vortices and to form flow temperature profile and pattern factors, (6) tangentially oriented driver openings induce a bulk swirl to provide turning benefit for the stage one turbine nozzle, or (7) any combination of the aforementioned advantages.

With respect to (1) and (2) above, the reverse flow annular vortex combustors take the inlet flow that would need to be turned to feed conventional swirlers and cooling holes, and incorporates that inlet flow into the primary zone vortex. With respect to (3) above, the inner liner contour geometry shapes the primary zone vortex while providing more volume on the inner liner cold side. The increased inner liner surface area and larger turning radius is advantageous for cooling and a smoother transition as the flow turns before entering the turbine. With respect to point (4), multiple counter rotating vortices spaced axially increase residence time and mixing. With respect to point (5), the driver openings improve mixing, which decreases the pattern factor, and with respect to (6), tangentially oriented driver openings form the vortices while adding bulk swirl to the flow to benefit the turbine stage one nozzle.

Further aspects are provided by the subject matter of the following clauses.

A gas turbine engine having a compressor section for compressing air flowing therethrough to provide a compressed air flow, and a reverse flow annular vortex combustor including a combustion chamber having a primary combustion zone, the combustion chamber configured to combust a mixture of a fuel flow and the compressed air flow in the primary combustion zone to generate a primary zone vortex. The reverse flow annular vortex combustor has a combustor liner and one or more driver openings extending radially through the combustor liner, the one or more driver openings providing a driver air flow formed of the compressed air flow, wherein the driver air flow enters the combustion chamber as a wall of air for shaping and driving the primary zone vortex in the combustion chamber.

The gas turbine engine of the preceding clause, wherein the one or more driver openings are angled in a circumferential direction.

The gas turbine engine of any preceding clause, wherein the one or more driver openings are angled with respect to a longitudinal centerline axis of the reverse flow annular vortex combustor.

The gas turbine engine of the preceding clause, wherein the one or more driver openings are at a tangential angle with the combustor liner to provide a bulk swirl to the driver air flow.

The gas turbine engine of any preceding clause, further comprising a plurality of cooling holes, wherein the one or more driver openings are larger than each of the plurality of cooling holes, and wherein the plurality of cooling holes provide cooling to the combustor liner but do not provide the wall of air.

The gas turbine engine of any preceding clause, wherein the combustor liner comprises an inner liner and an outer liner, and the inner liner is a contoured inner liner.

The gas turbine engine of any preceding clause, wherein the contoured inner liner enlarges an interior volume of an aft end of the combustion chamber as compared to the interior volume of a forward end of the combustion chamber.

The gas turbine engine of any preceding clause, further comprising a combustor casing surrounding the combustor, wherein an inner passage between the contoured inner liner and the combustor casing is larger at the forward end of the combustor as compared to the aft end of the combustor.

The gas turbine engine of any preceding clause, wherein the contoured inner liner provides a turning radius to a combustor outlet that provides a smooth flow into a stage one turbine.

The gas turbine engine of any preceding clause, wherein the one or more driver openings comprise a first driver opening and a second driver opening.

The gas turbine engine of any preceding clause, the combustor liner having an outer liner and an inner liner, wherein the first driver opening is provided in the outer liner and the second driver opening is provided in the inner liner.

The gas turbine engine of any preceding clause, wherein the first driver opening is axially staggered with the second driver opening.

The gas turbine engine of any preceding clause, wherein the primary zone vortex is maintained between an aft end of the combustion chamber and the first driver opening.

The gas turbine engine of any preceding clause, wherein the first driver opening and the second driver opening are axially staggered a distance that does not generate a secondary combustion zone and does not generate a secondary zone vortex.

The gas turbine engine of any preceding clause, wherein the first driver opening and the second driver opening are axially staggered a distance that provides a secondary combustion zone and generates a secondary zone vortex within the secondary combustion zone.

The gas turbine engine of any preceding clause, wherein the secondary zone vortex is downstream of and axially forward of the primary zone vortex.

The gas turbine engine of any preceding clause, wherein the primary zone vortex and the secondary zone vortex are counterrotating.

The gas turbine engine of any preceding clause, further comprising a third driver opening that is axially staggered from the second driver opening a distance that provides a tertiary combustion zone and generates a tertiary zone vortex within the tertiary combustion zone.

The gas turbine engine of any preceding clause, wherein the secondary zone vortex is downstream of and axially forward of the primary zone vortex, and the tertiary zone vortex is downstream of and axially forward of the secondary zone vortex.

The gas turbine engine of any preceding clause, wherein the primary zone vortex and the tertiary zone vortex rotate in the same direction, and the secondary zone vortex rotates in the opposite direction.

Although the foregoing description is directed to the preferred embodiments of the present disclosure, other variations and modifications will be apparent to those skilled in the art and may be made without departing from the disclosure. Moreover, features described in connection with one embodiment of the present disclosure may be used in conjunction with other embodiments, even if not explicitly stated above.

The invention claimed is:

1. A gas turbine engine comprising:

a compressor section for compressing air flowing therethrough to provide a compressed air flow; and a reverse flow annular vortex combustor including a combustion chamber having a primary combustion zone, the combustion chamber configured to combust a mixture of a fuel flow and the compressed air flow in the primary combustion zone to generate a primary zone vortex, the reverse flow annular vortex combustor including:

a combustor liner; and one or more driver openings extending radially through the combustor liner, the one or more driver openings providing a driver air flow formed of the compressed air flow, wherein the driver air flow enters the combustion chamber as a wall of air for shaping and driving the primary zone vortex in the combustion chamber, wherein one or more of the one or more driver openings are oriented at an angle in a downstream direction to direct the driver air flow in the downstream direction to pull combustion gases from the primary zone vortex downstream within the combustion chamber.

2. The gas turbine engine of claim 1, wherein the one or more driver openings are angled in a circumferential direction.

3. The gas turbine engine of claim 1, wherein the one or more driver openings are angled with respect to a longitudinal centerline axis of the reverse flow annular vortex combustor.

4. The gas turbine engine of claim 1, wherein the one or more driver openings are at a tangential angle with the combustor liner to provide a bulk swirl to the driver air flow.

5. The gas turbine engine of claim 1, further comprising a plurality of cooling holes, wherein the one or more driver openings are larger than each of the plurality of cooling holes, and wherein the plurality of cooling holes provide cooling to the combustor liner but do not provide the wall of air.

6. The gas turbine engine of claim 1, wherein the combustor liner comprises an inner liner and an outer liner, and the inner liner is a contoured inner liner.

7. The gas turbine engine of claim 6, wherein the contoured inner liner enlarges an interior volume of an aft end of the combustion chamber as compared to the interior volume of a forward end of the combustion chamber.

8. The gas turbine engine of claim 7, further comprising a combustor casing surrounding the reverse flow annular vortex combustor, wherein an inner passage between the contoured inner liner and the combustor casing is larger at the forward end of the reverse flow annular vortex combustor as compared to the aft end of the reverse flow annular vortex combustor.

9. The gas turbine engine of claim 7, wherein the contoured inner liner is contoured at the primary combustion zone by extending radially inward from the aft end to a minimal radial distance toward a longitudinal centerline axis of the reverse flow annular vortex combustor and extending radially outward away from the longitudinal centerline axis to a maximum radial distance at a contour axis, the primary combustion zone being defined between the aft end and the contour axis such that the contoured inner liner reinforces the primary zone annular vortex and provides a turning radius to a combustor outlet that directs a flow of the combustion gases into a first stage of a high-pressure turbine.

10. The gas turbine engine of claim 1, wherein the one or more driver openings comprise a first driver opening and a second driver opening.

11. The gas turbine engine of claim 10, the combustor liner having an outer liner and an inner liner, wherein the first driver opening is provided in the outer liner and the second driver opening is provided in the inner liner.

12. The gas turbine engine of claim 10, wherein the first driver opening is axially staggered from the second driver opening.

13. The gas turbine engine of claim 10, wherein the primary zone vortex is maintained between an aft end of the combustion chamber and the first driver opening.

14. The gas turbine engine of claim 10, wherein the first driver opening and the second driver opening are axially staggered a distance that does not generate a secondary combustion zone and does not generate a secondary zone vortex.

15. The gas turbine engine of claim 10, wherein the first driver opening and the second driver opening are axially staggered a distance that provides a secondary combustion zone and generates a secondary zone vortex within the secondary combustion zone.

16. The gas turbine engine of claim 15, wherein the secondary zone vortex is downstream of and axially forward of the primary zone vortex.

17. The gas turbine engine of claim 15, wherein the primary zone vortex and the secondary zone vortex are counterrotating.

18. The gas turbine engine of claim 15, further comprising a third driver opening that is axially staggered from the second driver opening a distance that provides a tertiary combustion zone and generates a tertiary zone vortex within the tertiary combustion zone.

19. The gas turbine engine of claim 18, wherein the secondary zone vortex is downstream of and axially forward of the primary zone vortex, and the tertiary zone vortex is downstream of and axially forward of the secondary zone vortex.

20. The gas turbine engine of claim 19, wherein the primary zone vortex and the tertiary zone vortex rotate in the same direction, and the secondary zone vortex rotates in the opposite direction.

* * * * *